United States Patent [19]

Leonard

[11] 3,991,910

[45] Nov. 16, 1976

[54] METHOD AND APPARATUS FOR PACKAGING DOWN

[75] Inventor: Randal K. Leonard, Broomfield, Colo.

[73] Assignee: Frostline, Inc., Broomfield, Colo.

[22] Filed: Apr. 17, 1975

[21] Appl. No.: 569,105

[52] U.S. Cl. ..... 222/1; 222/189; 222/440; 141/5; 141/67

[51] Int. Cl.[2] ..... B65B 3/04; B65B 1/04; B67B 7/00

[58] Field of Search ..... 141/1–12, 141/39–68, 34, 89–92, 258–262; 222/1, 195, 64, 383, 189, 440

[56] References Cited

UNITED STATES PATENTS 2,528,877 11/1950 Goldberg ..... 141/67

*Primary Examiner*—Houston S. Bell, Jr.
*Attorney, Agent, or Firm*—Edwin L. Spangler, Jr.

[57] ABSTRACT

This invention relates to a novel and improved method and apparatus used for the filling of small packets with a measured quantity of down which includes the steps of or the structure for sucking a measured quantity of down into a perforated cylinder closed at the lower end by a retractable gate, opening the gate while ejecting the down from the perforated cylinder by extending a plunger therein, blowing the down resting atop the extended plunger back into the hopper preparatory to retracting same, and reclosing the gate.

20 Claims, 2 Drawing Figures

METHOD AND APPARATUS FOR PACKAGING DOWN

Figure 1:
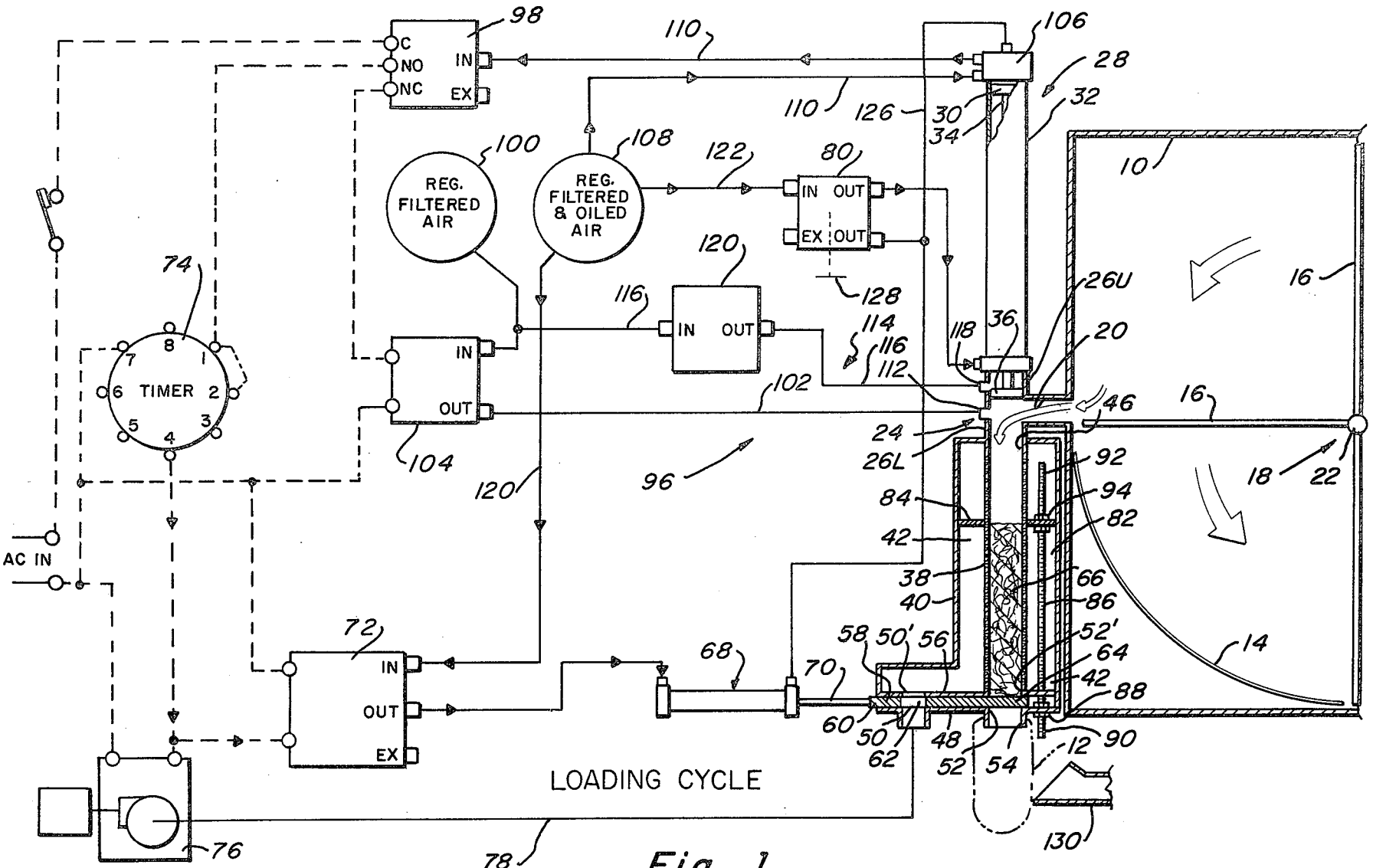

While backpacking in one form or another has been around as long as man himself, the advent of extremely lightweight down-filled gear for the backpacker and outdoorsmen and women generally is of relatively recent origin. The main drawback of such gear is that it is quite expensive and, therefore, beyond the reach of many who would like to own it. A major factor contributing to the high cost of ready-made down-filled clothing, sleeping bags and the like is, of course, the labor involved in making it; however, the problems associated with handling the down render these articles most difficult for the average seamstress to make in her home.

Some years back the assignee of the instant application solved this problem by making up kits for the customer to use in making up his or her own down articles at a cost competitive with other more conventional outerwear and camping gear. The secret of the success of these kits lay in the packaging of the down in such a way that the user could introduce it into the article without filling the house with feathers. One such down packet and method of using same forms the subject matter of U.S. Pat. No. 3,367,560.

As this kit business has grown over the past several years, it became imperative to find some way of packaging the down in packets more efficiently and inexpensively. While the prior art includes machines for packaging down and other lighweight materials such as, for example, those forming the subject matter of U.S. Pat. Nos. 2,979,086; 3,094,153; 3,386,372; 3,396,763; and 3,716,082, they all proved to have certain shortcomings which rendered them less than adequate for this purpose. One problem, of course, is obtaining a uniform measured quantity of down in each packet. The traditional approach to the solution of this problem with down and other lightweight finely-divided materials is to use a timed filling cycle. Unfortunately, this does not work well with down because, being a natural product, it is not uniform or at least not nearly as uniform as many other materials both synthetic and natural. The net result is that during a given time period, the weight of down dispensed may vary considerably due to its differences in density.

Another problem is that of damaging the down fibers by shearing the delicate so-called "bafbs", "barbules" and "barbicells" from the shaft thus destroying the vital "loft" so necessary for proper insulation and warmth. In general, the better the grade of down, the smaller the individual feathers, therefore, these tiny feathers easily invade the space left between the pistons and cylinders walls of the conventional plunger-type filling mechanisms where the aforementioned shearing or stripping action takes place as the parts reciprocate relative to one another. These feather shafts stripped of their barbs have virtually no insulating value and, in addition, they are both stiff and sharp. As such it is not at all unusual for them to work their way to the surface of the garment or other down-filled product where they eventually penetrate the fabric covering and produce the "scratchy" sensation so uncomfortable to the user.

By and large, however, the main problem with the prior art packaging machines for particulate matter is their utter inability to operate for any reasonable length of time without clogging, jamming or otherwise failing to function as intended. Such malfunctions range all the way from failing to dispense the proper quantity of product to a complete breakdown. The problems are generally attributable to the nature of the down itself rather than any mechanical dysfunction. Saying this another way, down will invade areas and parts that are easily shielded against other materials, it will float on the tiniest of air currents, its particles move randomly and erratically causing handling problems and, despite all this, it remains very delicate and easily damaged by rough handling.

Fortunately, it has now been discovered in accordance with the teaching of the instant invention that these and other shortcomings of the prior art packaging apparatus for particulate matter when used to handle down can, in large measure, be eliminated by the simple, yet unobvious, expedient of first keeping it fluffed up through agitation, sucking it into a perforated cylinder closed at one end and so designed that the down fibers will be retained therein while the air passes out through the walls thereof into a surrounding chamber, simultaneously opening the closed end and pushing the down within said perforated cylinder into a waiting receptacle by means of a substantially undersized piston-type plunger, and blowing any down trapped above the plunger back into the hopper preparatory to retracting the latter. By making the plunger undersized, the down along the walls of the perforated cylinder will escape being crushed and sheared during the dispensing operation. Also, by preventing the plunger from rubbing against the walls of the perforated cylinder, the troublesome build-up of static electricity is prevented. Some down along the walls of the cylinder will, of course, end up on top of the plunger when the latter extends as will a certain amount of down escaping from the hopper; however, this will be blown back into the hopper before the plunger is retracted.

The return of the plunger to is fully retracted home position initiates the filling cycle and, on rare occasions, a tuft of packed down that was not cleared by the blowback operation will prevent the plunger from completing its cycle. Should this occur, a separate manually operated high pressure airjet is used to clear away the impediment and restore the system to normal operation.

It is, therefore, the principal object of the present invention to provide a novel and improved filling apparatus for packaging down in packets.

A second objective of the within described invention is the provision of a unique down packaging method.

Another object of the invention herein disclosed and claimed is to provide apparatus of the character described which is capable of reliably and repeatedly dispensing a measured quantity of down.

Still another objective is the provision of down-handling equipment that can be relied upon to move the down quickly and efficiently from a storage hopper into the individual packets without damaging same.

An additional object is to provide a packaging machine for down which includes an improved mechanism for quickly and easily adjusting and varying the amount of down dispensed during each filling cycle.

Further objects of the claimed invention are to provide an apparatus for filling individual packets with a measured quantity of down that is simple, trouble-free, easy to service, fast, rugged, versatile, easy to use, relatively inexpensive and readily adaptable to various grades and densities of down.

Figure 2:
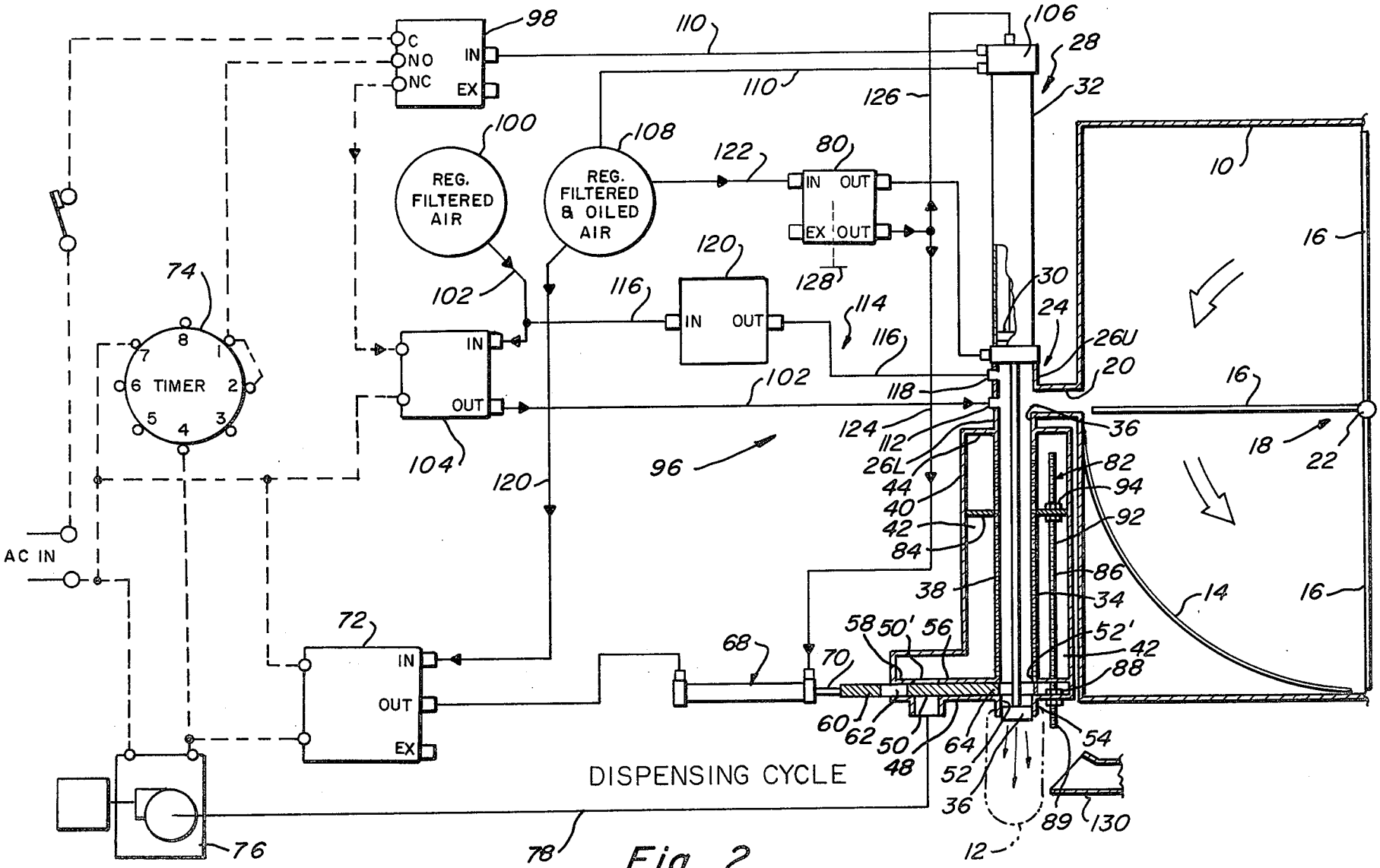

Other objects will be in part apparent and in part pointed out specifically hereinafter in connection with the description of the drawings that follows, and in which:

FIG. 1 is a side elevational view, portions of which have been illustrated schematically while other portions have been broken away and shown in section, detailing the loading cycle during which the perforated cylinder is sucked full of down up to a pre-set level; and, FIG. 2 is a view like FIG. 1 except that the apparatus is shown at the completion of the dispensing cycle.

Referring next to the drawings for a detailed description of the present invention, reference numeral 10 designates a hopper into which is introduced the bulk down preparatory to its being packaged in individual packets, the latter having been shown by broken lines and given the numeral 12 for identification. Inside the lower portion of the hopper is a semicylindrical partition wall 14 which is swept by the vanes 16 of a paddle wheel type agitator indicated in a general way by numeral 18 and which turns slowly counterclockwise as indicated by the arrows. This paddle wheel is turned at a rate sufficient to keep the down fluffed up and suspended in midair in which condition it can be sucked most easily from the down discharge conduit 20. The paddle wheel is journalled for rotation about a transverse axis defined by shaft 22 that mounts the vanes 16.

Conduit 20 forms the stem of a T-fitting broadly designated by reference numeral 24. The crossbar portion 26 of this T-fitting extends vertically and is divided into upper and lower branches 26U and 26L, respectively. Mounted atop upper crossbar branch 26U of the T-fitting 24 is an air operated double-acting servomotor that has been generally indicated by reference numeral 18 and which includes a piston 30 mounted for reciprocating movement inside cylinder 32. Piston rod 34 projects beyond the lower end of the cylinder 32 where it is fitted with a cylindrical disc 36 that defines a plunger.

Referring only to FIG. 1 for the moment, it will be noted that when the piston is in fully-retracted position, the plunger 36 is drawn up into the upper crossbar branch 26U of the T-connection 24 thus producing a gate effectively blocking the entrance thereto. When so positioned, it not only prevents the down leaving the hopper through the discharge conduit from entering this upper branch of the T-fitting but, even more importantly, keeps the plunger up and out of the way so that the down will not collect thereon as it makes the right angle turn down into the lower branch 26L.

Returning again to both figures of the drawing, a perforated cylinder 38 is connected to the lower branch 26L of the T-fitting so as to form a continuation thereof. This perforated cylinder is also arranged coaxially with the servomotor cylinder 32 so as to receive plunger 36 during the working or extension stroke of the piston. The holes in this perforated cylinder are approximately 1/16 inch in diameter which is small enough to stop the down fibers from passing therethrough under the influence of a differential pressure applied across its walls. While some particulate matter does escape the perforated cylinder through these holes, it is largely trash and other impurities that does so, therefore, a most desirable classification screening takes place, the net result of which is to upgrade the quality of the down being packeted.

It is an important, and presumably novel, feature of the present invention to make the plunger 36 considerably undersize relative to the interior dimensions of the perforated cylinder, specifically, in the order of about ¼ inch smaller or so. By doing this, the plunger does not rub the sides of the cylinder and create static electricity which is a problem of considerable importance when dealing with down which is highly susceptible thereto. Moreover, since a substantial amount of the down filling the perforated cylinder is sucked up snugly against the walls thereof due to the lower pressure existing outside it, a close fitting piston will, as previously mentioned, damage the fibers by crushing them and shearing the barbs, barbules and barbicells from their shafts thus destroying the downs insulating value. By leaving an ⅛ inch gap or so around the plunger, these undesirable consequences of a close fitting piston are eliminated while, at the same time, the plunger still remains effective to push the down from the perforated cylinder primarily because the individual particles are so arranged and interwined that their collective size exceeds ⅛ inch and they are, for this reason, picked up by the plunger.

Now, the perforated cylinder 38 is housed inside a solid walled housing 40 which surrounds same and leaves an annular chamber 42 therebetween. The top wall 44 of this housing has an opening 46 therein which connects onto the lower end of the lower branch 26L of the T-shaped fitting 24 and defines the entrance to the perforated cylinder 38. Bottom wall 48, on the other hand, contains a pair of openings 50 and 52, the former comprising the vacuum port through which the vacuum is drawn in chamber 42 while the latter opening 52 registers with the tubular extension 54 of the perforated cylinder through which the down therein is discharged and onto which the packet 12 is held or temporarily secured.

Immediately above this bottom wall is spaced substantially parallel relation thereto is a partition wall 56 which cooperates with the bottom wall to define a channel 58 within which gate 60 slides. Openings 50' and 52' in this partition wall 56 register with the corresponding openings 50 and 52 in bottom wall 48 as shown.

Gate 60, in the particular form shown, has a single opening 62 therein which, in the fully extended position thereof shown in FIG. 1, registers with the vacuum openings 50 and 50' of walls 48 and 56 while the remote end 64 thereof blocks opening 52' at the lower end of the perforated cylinder thus supporting the column of down 66 thereabove. Conversely, when gate 60 is retracted as shown in FIG. 2, the remote end 64 uncovers both openings 52' and 52 allowing the plunger 36 to extend therethrough and push the column of down 66 out the bottom of tube 54 into packet 12. While this occurs, opening 62 in the gate 60 has moved to the left out of register with vacuum openings 50 and 50' thus shutting off the vacuum to annular chamber 42.

Movement of the gate 60 between its extended position of FIG. 1 and its retracted position of FIG. 2 is accomplished in a conventional way by a second double-acting air-operated servomotor severally indicated by numeral 68 like servomotor 28. The piston rod 70 of this servomotor 68 connects onto gate 60 and is operative upon actuation in one direction to extend same and in the opposite direction to retract it. Extension of gate 60 is controlled by means of control valve 72 which feeds air to servomotor 68 over a predetermined time interval set in timer 74. This same timer controls vacuum motor 76 which is connected by conduit 78 to suck air through registered openings 50, 62 and 50' from annular chamber 42 as will be explained in somewhat greater detail presently. On the other hand, control valve 80 controls the supply of air to both servomotors 28 and 68 so as to simultaneously extend the plunger 36 while retracting gate 60 to open the perforated cylinder 38 and shut off the vacuum to chamber 42.

Now, it is possible to control the amount of down entering the perforated cylinder 38 in several ways. For instance, by drawing a constant vacuum over a fixed time interval, a predictable measured quantity of down will enter perforated cylinder 38. If one were to leave the time interval unchanged and increase the vacuum, a greater quantity of down would enter the cylinder and become more tightly packed. On the other hand, leaving the negative pressure unchanged and increasing the time interval can also be used to increase the amount of down delivered into cylinder 38. In accordance with the teaching of the instant invention, however, neither of these methods is used. Instead, an adjustable baffle system broadly designated by reference numeral 82 is used for controlling the quantity of down entering cylinder 38 during each packaging cycle.

Vacuum motor 76 draws a constant vacuum in accordance with the teaching of the instant system. The time interval set on timer 74 is then chosen such that at the vacuum drawn by motor 72, perforated cylinder 38 will have sufficient time to fill up to the level of the baffle 84. For all practical purposes, no more down will enter the perforated tube once it reaches the level of the baffle even though the vacuum continues to be drawn in chamber 42. In reality, of course, some increase in the amount of down will, in fact, take place if the vacuum is applied over an extended interval because of some compaction that occurs. Conversely, there is little detectable difference in the amount of down in cylinder 38 once it is filled up to the level of baffle 84 if the suction is continued for a few seconds longer than normal. This is only true, of course, once the cylinder is filled to the level of the baffle because the down will continue to enter it at a rapid rate until it reaches this point so long as the vacuum is still applied. In other words, prolonging the time interval even a fraction of a second with the cylinder only partially full will have a material effect on the amount of down therein.

It has been found that the use of this adjustable baffle system 82 materially improves the accuracy of the measured quantities of down dispensed during each cycle when compared with varying the negative pressure or the duration of the cycle or both. The adjustment of the baffle to either increase or decrease the measured amount of down contained within cylinder 38 is, likewise, simply accomplished by means of a jackscrew 86 journalled for rotation in fitting 88 in the bottom wall 48 of the housing so as to leave a portion 90 accessible on the exterior thereof as shown. This jackscrew extends upwardly within chamber 42 where the threaded section 92 thereof screws through nut 94 fastened to the baffle itself. Rotation of the jackscrew in one direction causes the nut to climb the threads and raise the baffle, whereas, rotation in the opposite direction lowers the latter.

The baffle 84 cooperates with perforated cylinder 38 and housing 40 to divide chamber 42 into a low pressure compartment at the negative pressure established by the vacuum system when the latter is operating with port 62 aligned with openings 50 and 50', and an ambient pressure zone at the same pressure as the T-fitting and hopper. The low pressure zone, of course, lies underneath the baffle while the ambient pressure zone is above it. With the hopper, T-fitting and ambient pressure zone all at essentially the same pressure, once the perforated cylinder fills to the level of baffle 84, all further down flow stops. This is because the down in the lower part of the perforated cylinder has plugged the holes in it thereby raising the pressure until it reaches an equilibrium with the pressure in the system above the baffle.

One of the most important and novel features of the instant invention is the so-called blowback system which has been indicated in a general way by reference numeral 96 and includes a normally-closed pilot-controlled switch 98 held open by piston 30 of servomotor 28 when in fully retracted position, a source of filtered air 100 under pressure, a conduit 102 connecting said source of compressed air into the T-fitting 24 opposite the stem 20 thereof, and a control valve 104 connected into said conduit and operative upon release of switch 98 into closed position to open and introduce flow of air into the hopper so as to prevent any more down from leaving same until the plunger has pushed the down in cylinder 38 out tube 54 and returned to its fully retracted position. A normally-closed pilot valve 106 located in the top of the cylinder 32 of servomotor 28 is held open whenever the piston 30 thereof is in the fully-retracted position shown in FIG. 1. When thus held open, this pilot valve admits filtered air under pressure from source 108 into normally closed air-controlled valve 98 through conduit 110 which functions to keep it open. Then, as soon as the piston 30 of servomotor 28 moves away from its fully-retracted position allowing pilot valve 106 to return to its normally-closed position and shut off the air supply to valve 98 allowing the latter to assume its normally-closed position, valve 98 will actuate valve 104 and open same to admit air to the hopper until the piston 30 once again returns home, the latter condition having been shown in FIG. 2. It should be noted that any down resting atop plunger 36 will be lifted thereby on the return or retraction stroke of servomotor 28 up into the path of the air issuing from the nozzle 112 at the end of conduit 102 thus sweeping same back into the hopper. On rare occasions, however, the relatively low velocity jet of air issuing from conduit 102 which is preferably a ¼ inch line is insufficient to dislodge a plug of down impacted about the piston rod 34 atop plunger 36. When this happens, such a plug will keep the piston from returning to its fully-retracted position where it reopens the pilot valve 106 and shuts down the blowback system 96. As a result, improved means indicated in a general way by numeral 114 have been provided for clearing away such obstructions, This obstruction clearing mechanism comprises a relatively larger diameter conduit 116 (approximately ⅜ inch diameter) connected to receive air from source 108 and deliver same to the upper branch 26U of the T-fitting 24 by means of nozzle 118. Connected in this air line 116 is a manually-operated valve 120 which can be opened to clear the plug whenever the occasion demands.

Valve 72 controlling servomotor 68 is connected by air line 120 to receive compressed air from source 108 after it has been filtered, lubricated and regulated as to pressure. Actuation of this valve is controlled by timer 74 which opens same to admit air to the servomotor and extend gate 60 into the position shown in FIG. 1 while simultaneously actuating vacuum motor 76. As soon as timer 74 times out, motor 76 will shut off air line 120. At the same time, however, valve 80 connected to receive air from source 108 via air line 122 will actuate to deliver air through line 124 to retract the piston rod 20 of servomotor 68 thereby closing off vacuum port 62 while opening up the perforated cylinder 38 as shown in FIG. 2. The same actuation of valve 80 to the position shown in FIG. 2 also actuates servomotor 28 into extended position by releasing air to the top end through air line 126. This valve 80 is a manually-actuated valve, the normal or unactuated position thereof being that shown in FIG. 1 wherein the plunger 36 is fully retracted. A foot pedal indicated schematically by numeral 128 is used by the operator to actuate same into the operative position of FIG. 2.

Now, as the piston 30 of servomotor 28 returns to the fully-retracted position of FIG. 1, it actuates pilot valve 106 into closed position thus letting switch 78 held open thereby to close and initiate the vacuum cycle by energizing motor 76 and extending gate 60 to place port 62 in communication with the interior of chamber 42. Thus, this vacuum cycle is initiated automatically by the return to home position of piston 30 and, furthermore, it is terminated automatically when timer 74 times out and shuts down motor 76 while, at the same time, deactuating valve 72 to cut off the supply of air to servomotor 68. At this point, however, everything stops with the gate 60 still extended, vacuum port 62 still aligned with openings 50 and 50', the lower end of perforated cylinder 38 still closed by gate 60, said cylinder filled with down up to the level of the baffle, and plunger 36 fully retracted. Treadle-operated valve 80 is deactuated as shown in FIG. 1 so that the air in line 122 is being fed into the lower end of cylinder 32 of servomotor 28 to hold the piston 30 in fully-retracted position.

At this point in time, the operator places an open packet 12 over tubular discharge chute 54 and hits the treadle 128 to actuate valve 80. As soon as this occurs, air from source 108 enters air line 124 to return servomotor 68 to its retracted position thus closing vacuum port 62 and opening the bottom end of cylinder 38. Simultaneously, air is released into line 126 to actuate servomotor 28 and extend plunger 36 to push the column of down in cylinder 38 out through its lower end into the waiting packet.

Simultaneously with the extension of plunger 36, air-operated switch 98 returns to its normally-closed position after being held open by the pilot valve 106. As switch 98 closes, it actuates valve 104 to release air into line 102 which escapes through jet 112 and blows the down back into the hopper so long as the piston 30 of servomotor 28 remains anywhere but in its fully-retracted position. Any down or dust that escapes is carried off through dust collector 130 which is connected to a vacuum source (not shown).

Finally, as long as the operator holds the treadle 128 depressed to shift valve 80 into the position shown in FIG. 2, the plunger 36 will remain fully extended and the blowback system 96 will continue to operate to keep the down in the hopper. Upon release of the treadle, valve 80 will immediately deactuate to shut off the air supply to both the top of servomotor 28 and the right-hand end of servomotor 68 while connecting air into the bottom of servomotor 28 (line 122) that returns the piston 30 to fully-retracted position. It is significant to note, however, that even though valve 80 has been released to its deactuated position of FIG. 1, blowback system 96 continues to operate clearing down from above plunger 36 as it rises in perforated cylinder 38 and the branches of the F-fitting. In fact, this blowback system continues to function until the piston 30 returns all the way to home position and actuates the pilot valve 126 to reopen switch 98 and deenergize valve 104. Should, perhaps, a tuft of down remain packed around piston rod 34 that cannot be dislodged by the blowback system 96 then piston 30 cannot fully retract to actuate the pilot valve as intended. When this occurs, the manually-operated declogging system 114 is brought into play previously described.

What is claimed is:

1. Apparatus for dispensing a measured quantity of down which comprises: a hopper having an outlet; a perforated cylinder open at both ends and connected to receive down from the outlet of the hopper; a first piston servomotor arranged in end-to-coaxial relation with the perforated cylinder; plunger means connected to the first servomotor operative upon actuation of said first servomotor to extend into one end of the perforated cylinder and push any down contained therein out its other end; an imperforate housing enclosing the perforated cylinder in spaced relation to define a vacuum chamber therearound, said housing containing a vacuum port communicating the interior of the vacuum chamber; second piston servomotor means movable upon actuation between a first position and a second position; gate means connected to said second servomotor means effective in the first position of said second servomotor to open up the vacuum port and shut off said other end of the perforated cylinder, and said gate means functioning in the second position of said second servomotor means to close said vacuum port while opening said other end of the perforated cylinder; vacuum means connected into the vacuum chamber through the vacuum port operative in the first position of the second servomotor means to suck down from the hopper into the perforated cylinder; and, blowback means connected opposite the outlet from the hopper for directing a jet of air thereagainst, said means being operative upon actuation to keep the down inside the hopper.

2. Apparatus in accordance with claim 1 wherein the plunger upon extension moves between the outlet from the hopper and blowback means, and in which said blowback means is operative upon extension of said plunger to return at least a portion of the down trapped therebehind to the hopper.

3. Apparatus in accordance with claim 1 wherein the plunger is undersize in comparison to the inside diameter of the perforated cylinder so as to leave a gap therebetween effective to permit said plunger to sweep down therefrom without appreciably crushing it.

4. Apparatus in accordance with claim 1 including means connected to the blowback means and to the first piston servomotor responsive upon actuation of the latter into extended position to actuate said blowback means and maintain same actuated until said first servomotor returns to its fully-retracted position.

5. Apparatus in accordance with claim 1 including first valve means connected to said first and second servomotors, said means being operative in a first position upon connection to a source of air under pressure to extend the first piston servomotor and simultaneously actuate the second servomotor means into its second position.

6. Apparatus in accordance with claim 1 including an adjustable baffle mounted within the vacuum chamber sealing the gap between the housing and perforated cylinder, said baffle being adjustable in the direction of the length of the perforated cylinder and operative when so adjusted to vary the quantity of down sucked into the latter.

7. Apparatus in accordance with claim 1 including a T-fitting having a stem portion connected to receive down from the outlet of the hopper and deliver same to the crossbar portion thereof intermediate its ends, said crossbar portion having one branch thereof connected to deliver down to said end of the perforated cylinder a second branch connected to the first piston servomotor in position to guide the plunger into said perforated cylinder.

8. Apparatus in accordance with claim 1 including a nozzle positioned to direct a stream of air at the end of the first piston servomotor to which the plunger is attached, conduit means connected to deliver air to said nozzle connectable to a source of high pressure air, and manually-actuated valve means connected into said conduit means operative upon actuation to direct a high pressure jet of compressed air between said plunger and adjacent servomotor end effective to clear a wad of down impacted therebetween.

9. Apparatus in accordance with claim 1 including second conduit means connectable to a source of air under pressure and connected to said second servomotor means for actuating the same from the first position into the second position, second valve means connected into the second conduit means operative upon actuation to deliver air to said second servomotor, and means comprising a timer connected to said second valve means and the vacuum means operative to simultaneously actuate said second valve means and vacuum means for a pre-set interval.

10. Apparatus as set forth in claim 3 in which the gap comprises an annular space of approximately ⅛ inch.

11. Apparatus in accordance with claim 4 wherein said means includes a normally-closed pilot valve operatively connected to the first servomotor means for actuation into open position upon movement of said servomotor into fully-retracted position, solenoid valve means connectable to a source of air under pressure and to a source of electrical energy operative upon energization to admit air to said blowback means, and normally closed air-operated switch means connectable to receive air from a pressurized source thereof through said pilot valve, said switch means being actuated into open position when receiving air through said pilot valve held open by said first servomotor in fully retracted position, and said switch means being released into closed position to energize said solenoid valve upon extension of said first servomotor to return the pilot valve to its normally-closed position.

12. Apparatus in accordance with claim 5 in which said first valve means includes a second position operative to actuate the first servomotor into fully-retracted position.

13. Apparatus in accordance with claim 7 in which the first servomotor in fully-retracted position is operative to retract the plunger into said second branch of the crossbar portion of the T-fitting.

14. The method of dispensing measured amounts of down from a bulk supply thereof by means of a perforated tube having an open end and means opposite the open end for opening and closing the same which comprises the steps of: sucking a charge of down from the bulk supply into the open end of the perforated tube while the other end thereof remains closed by establishing a negative pressure outside said tube, shutting off the vacuum and opening up the closed end of the tube preparatory to discharging the charge of down through the latter; emptying the charge of down from the tube through the open end thereof while establishing a positive pressure outside said bulk supply effective to keep the remaining supply of down therein, reclosing the open end of the tube to receive another charge of down and shutting off the positive pressure outside the bulk supply.

15. The method as set forth in claim 14 which includes the step of continuing the sucking step for a predetermined timed interval.

16. The method as set forth in claim 14 which includes the step of continually agitating the supply of down to maintain same fluffed up and in a state of suspension at least during the sucking step.

17. The method as set forth in claim 14 which includes the step of blocking off the negative pressure to said tube at a selected level spaced from the closed end thereof and maintaining an ambient pressure condition from said level to the open end during the sucking step.

18. The method as set forth in claim 14 wherein the step of emptying the down from the tube is accomplished by pushing it therefrom.

19. The method as set forth in claim 14 which includes the step of returning down that has escaped into the tube following initiation of the discharge step and prior to commencement of the sucking step to the bulk supply.

20. The method as set forth in claim 17 wherein the sucking step is continued for an interval at least as long as that required to fill the perforated tube with down up to the predetermined level.

* * * * *